US012337204B2

(12) United States Patent
Byun

(10) Patent No.: US 12,337,204 B2
(45) Date of Patent: Jun. 24, 2025

(54) STANDING SQUAT CALF RAISE

(71) Applicant: NEWTECH WELLNESS CO., LTD., Gimhae-si (KR)

(72) Inventor: Hyun Jung Byun, Busan (KR)

(73) Assignee: NEWTECH WELLNESS CO., LTD., Gimhae-si (KR)

( * ) Notice: Subject to any disclaimer, the term of this patent is extended or adjusted under 35 U.S.C. 154(b) by 66 days.

(21) Appl. No.: 18/226,805

(22) Filed: Jul. 27, 2023

(65) Prior Publication Data

US 2024/0042261 A1 Feb. 8, 2024

Related U.S. Application Data

(63) Continuation of application No. PCT/KR2022/020186, filed on Dec. 13, 2022.

(30) Foreign Application Priority Data

Aug. 8, 2022 (KR) ..... 10-2022-0098763

(51) Int. Cl.
*A63B 21/06* (2006.01)
*A63B 21/00* (2006.01)
*A63B 23/04* (2006.01)

(52) U.S. Cl.
CPC ..... *A63B 21/0615* (2013.01); *A63B 21/4033* (2015.10); *A63B 21/4047* (2015.10); *A63B 23/0405* (2013.01); *A63B 2023/0411* (2013.01)

(58) Field of Classification Search
CPC ..... A63B 21/0615; A63B 21/0616; A63B 21/0617
See application file for complete search history.

(56) References Cited

U.S. PATENT DOCUMENTS 4,357,010 A * 11/1982 Telle ..... A63B 21/4047 482/97
6,312,365 B1 11/2001 Koenig
10,343,008 B2 * 7/2019 Pullins ..... A63B 23/03525
2016/0346586 A1 * 12/2016 Pullins ..... A63B 21/4033
2020/0338391 A1 * 10/2020 Hall ..... A63B 21/0724

FOREIGN PATENT DOCUMENTS

CN 206381544 U 8/2017
CN 108785995 A 11/2018
KR 10-1298882 B1 8/2013
KR 10-2022-0039968 A 3/2022

OTHER PUBLICATIONS

International Search Report for PCT/KR2022/020186 mailed May 8, 2023 from Korean Intellectual Property Office.

* cited by examiner

*Primary Examiner* — Zachary T Moore
(74) *Attorney, Agent, or Firm* — Revolution IP, PLLC

(57) ABSTRACT

As for the standing squat calf raise according to an embodiment of this invention, the inclination of the stool where the user stands to perform an action of lifting or lowering a load toward the floor is varied while placing his or her feet flat on the floor, wherein it includes a frame unit forming a mounting space with multiple frames connected to the frame unit above to be rotatable, and it shall mediate the load application unit for applying a load in the direction of the floor, a stool unit formed on the lower part of the front side of the frame unit to provide a space for the user to step on, load application unit, and the frame unit to include a operational mounting unit to allow for the load application unit to be held at a certain height.

2 Claims, 9 Drawing Sheets

STANDING SQUAT CALF RAISE

TECHNICAL FIELD

This invention works in relation to a standing squat calf raise. Specifically, it is a standing squat calf raise in which a user can perform an act of lifting or lowering a load toward the floor on foot.

BACKGROUND ART

Calf raise is an exercise that trains the calves through the process of weight training.

In general, it is most desirable to move up and down as wide as possible while standing on the front sole of the foot on places like the staircase. However, if the situation does not allow it, its short exercise performance can be effective. It is preferable to have a wide range of motion.

The motion is initiated in a squatting position while lifting and lowering the tips of one's toes and continuing to hold up with the buttocks while pushing the latissimus dorsi muscle and lifting the waist as much as possible.

The weight of the barbell or dumbbell should be light compared to those used when squatting. The body may tremble and it may be difficult to keep one's center of gravity compared to performing normal squats. Thus, if one feels the need to adapt to the calf raise posture in the beginning, it is recommended to try it out first on the Smith machine.

It is advantageous in that exercises can be performed anywhere where one can stand. If the range of motion and exercise speed are reduced, one can perform exercises without standing out too much in public and this will not look strange to others. In addition, since the exercise effect will vary depending on the posture, many variations exist due to its simplicity.

PRIOR ART LITERATURE

Patent Literature

Korean Patent Publication No. 10-2022-0039968

DISCLOSURE OF INVENTION

Tasks to be Resolved

This invention aims to provide a standing squat calf raise machine that can increase the user's exercise efficiency by varying the inclination of the stool where the user stands to perform an action of lifting or lowering a load toward the floor while placing his or her feet flat on the floor.

Means to Resolve Tasks

As for the standing squat calf raise according to an embodiment of this invention, the inclination of the stool where the user stands to perform an action of lifting or lowering a load toward the floor is varied while placing his or her feet flat on the floor. It shall include a frame unit forming a mounting space with multiple frames connected to the frame unit above to be rotatable, and it shall mediate the load application unit for applying a load in the direction of the floor, a stool unit formed on the lower part of the front side of the frame unit to provide a space for the user to step on, load application unit, and the frame unit to include a operational mounting unit to allow for the load application unit to be held at a certain height. In addition, the stood unit may change the inclination of the surface on which the user steps on by varying the height of one side of the rear.

As for the stool unit of the standing squat calf raise according to an embodiment of this invention, it shall include a primary stool landing unit settled on the frame unit above and the frame unit while placed apart from the stool landing unit, a stool base frame having a secondary stool landing unit forming multiple hanging units formed along the height direction and its single side connected to the primary stool landing unit. The other side shall have a stool landing unit that provides a space for the user to step on while being connected to the secondary stool landing unit, and multiple hanging units shall be arranged in the order of a primary hanging, secondary hanging, and tertiary hanging parts placed facing the upper side from the lower side. The stool landing unit above shall be connected to the support unit consisting of a primary support plate and a secondary support plate connected to each other and to one end of the secondary support plate facing the secondary stool landing part at a certain angle to be equipped with an adjustment bar hanging on the holding unit. The adjustment bar may be hanging from any one of the hanging units above to allow for the relevant inclination to be changed with respect to the bottom surface of the support plate unit.

As for the frame unit of the standing squat calf raise according to an embodiment of this invention, it shall include a rectangular frame-shaped support frame supported on the floor, a standing frame standing upright and connected to the rear side of the support frame connected to the standing frame while mediating the mounting frame that protrudes toward the stool and connected to the operational mounting unit and the support frame above to be equipped with a reinforcing frame to reinforce the connection of the standing frame to the support frame, and as for the reinforcing frame, a hanging unit protruding from the outside can be formed to provide a space for hanging objects.

As for the load application unit of the standing squat calf raise according to an embodiment of this invention.

while being connected to the standing frame with its rotation capability, the main rotation unit extending to the upper side of the stool unit is connected to the standing frame while being rotatable, it shall be placed lower than the main rotation unit, the sub-rotation unit extending to the upper side of the stool unit and the main rotation unit connected to the sub-rotation unit, it shall be equipped with a connection link unit for changing the distance between the main rotation unit and the sub rotation unit. The rotatable main rotation unit shall be connected to the standing frame and one end of the main rotation bar while being connected to the load bearing part composed of a parallel bar and a curved bar that is curved from the parallel bar to provide a space for gripping and the lower side of the parallel bar and it shall include a buffer unit formed of a buffer material. As for the parallel bar, it shall consist of a parallel body unit formed in a shape of a straight line and a bent unit bent from the end of the parallel body, The buffer unit includes a main cushion unit formed in the parallel body to provide a cushion-like effect and an auxiliary cushion unit formed in the curved part to provide a cushion-like effect and the sub-rotation unit includes a rotatable sub-rotation bar connected to the standing frame and a sub-mounting unit connected to both ends of the sub-rotation bar. As for the connecting link unit, it is connected to a primary rotation bar connected to the main rotation bar and to the sub-rotation bar to be rotatable, and it shall be equipped with a secondary rotation bar connected to the primary rotation bar in multiple steps concentrically and a height adjusting unit that determines the sliding status of the secondary rotation bar with respect to the primary rotation bar. As for the load application unit, it shall mediate the standing frame and the load supporting unit to guide the rotation of the main rotation unit with respect to the standing frame and shall further provide a guide link unit to reinforce the connecting structure.

As for the operational mounting unit of the standing squat calf raise according to an embodiment of this invention, the settling rotation unit connected to the mounting frame is to be rotatable. It is connected to the standing frame to be rotatable and a mounting connection unit providing a primary and a secondary connection rotation shaft, one side is connected to the settling rotation unit and the other side is connected to the primary connection rotation shaft to allow for the rotational force of the mounting connection unit to be transmitted to the settling rotation unit, an application rotation unit is connected to be rotatable, and an application rotation unit provides a tertiary connecting rotation shaft, one side is connected to the tertiary connection rotation shaft and as for the secondary operational linkage unit, the other side is connected to the secondary connection rotation shaft to transmit the rotational force of the application rotation unit to the mounting connection unit and it is connected to the application rotation unit and equipped with an application handle providing a space for application of an external force by the user. As for the rotational force applied to the application handle, it is transmitted to the settling rotation unit through the application rotation unit, the secondary operational linkage unit, the mounting connection unit, and the primary operational linkage unit. As for the settling rotation unit, the sub-rotation bar is placed on the path of its movement to support the sub-rotation bar, or it does not limit the positional movement of the sub-rotation bar when it deviates from the movement path of the position of the sub-rotation bar depending on the direction of the rotational force applied to the application handle.

Effects of the Invention

This invention aims to provide a standing squat calf raise machine that can increase the user's exercise efficiency by varying the inclination of the stool where the user stands to perform an action of lifting or lowering a load toward the floor while placing his or her feet flat on the floor.

BRIEF DESCRIPTION OF DRAWINGS

Drawing 1 is a schematic view that shows a standing squat calf raise according to an embodiment of this invention.

Drawing 2 is a schematic view that describes the frame unit of the standing squat calf raise according to an embodiment of this invention.

Figure 1:
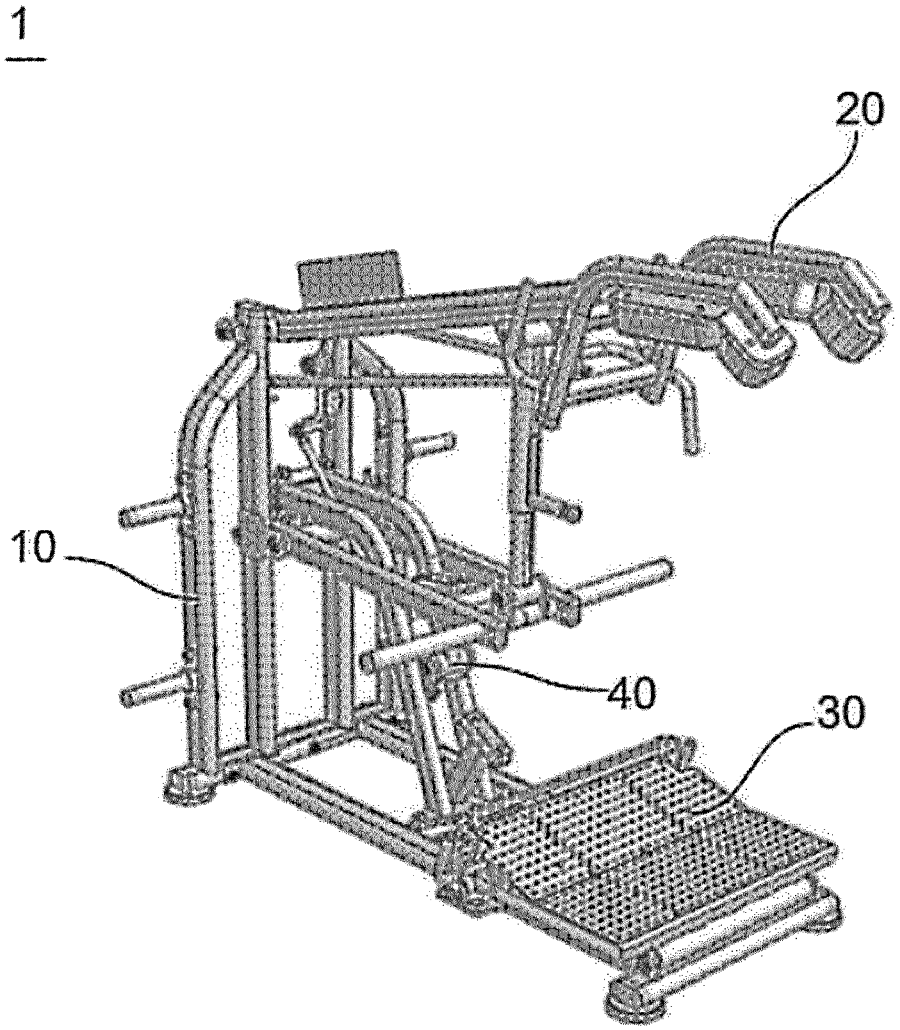
Figure 2:
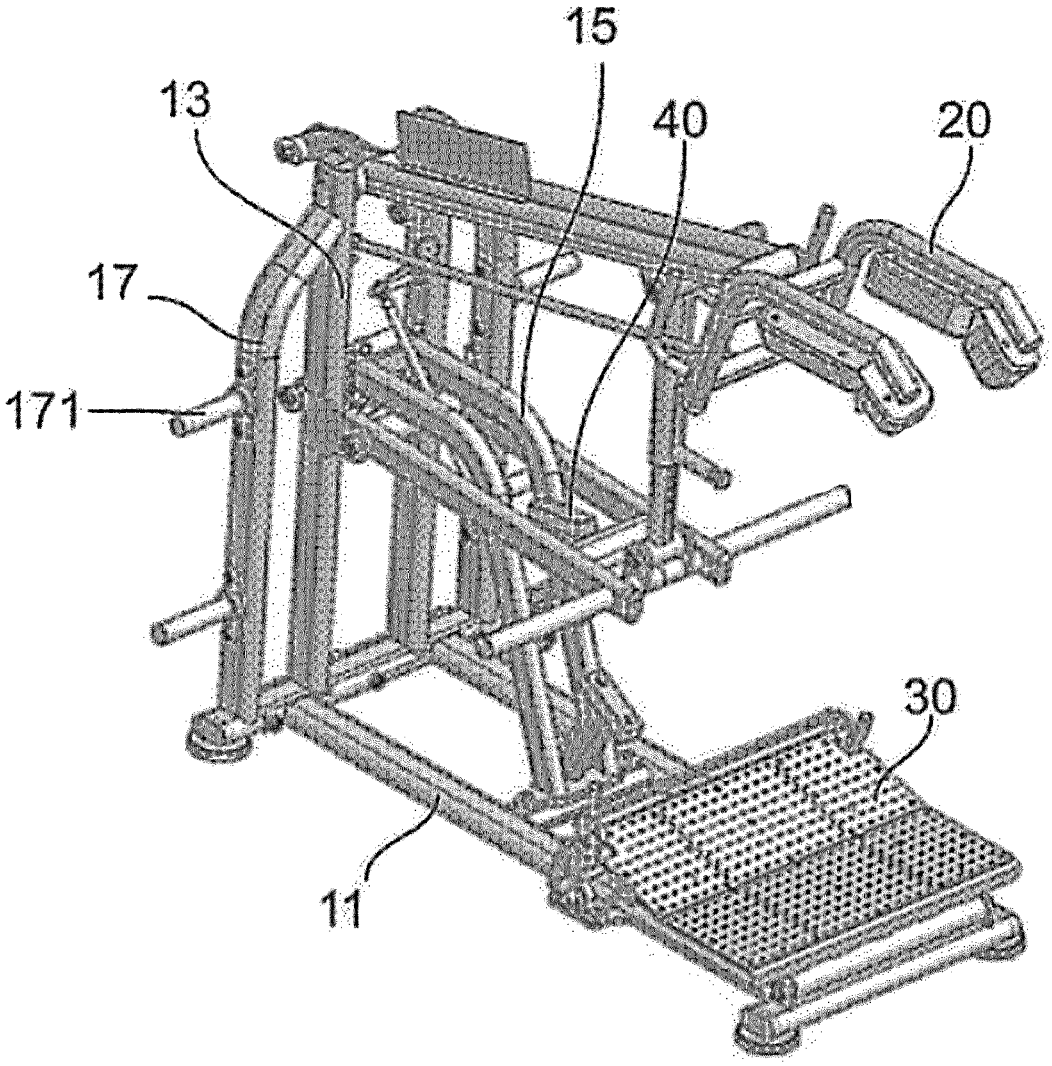
Figure 3:
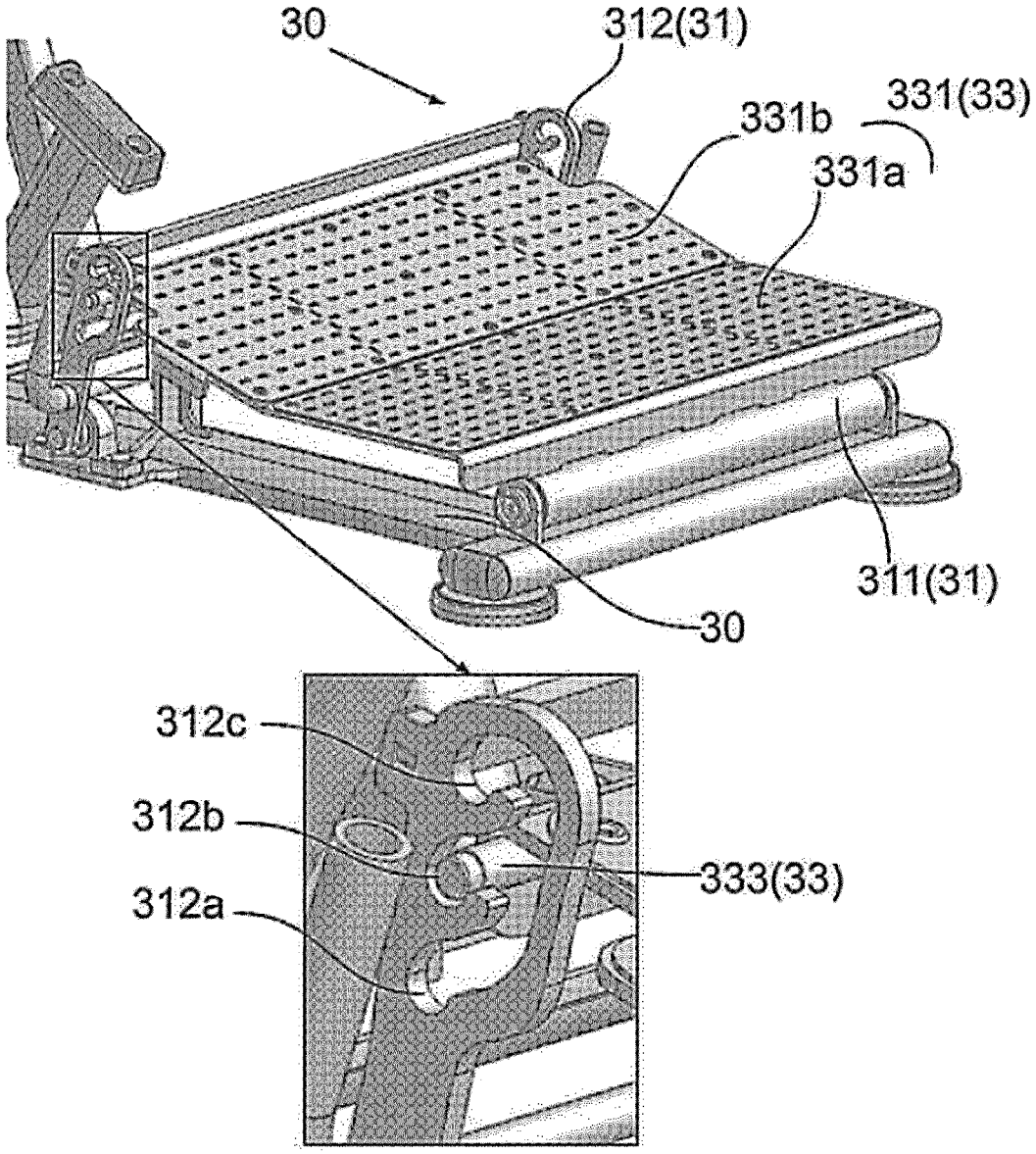
Figure 4:
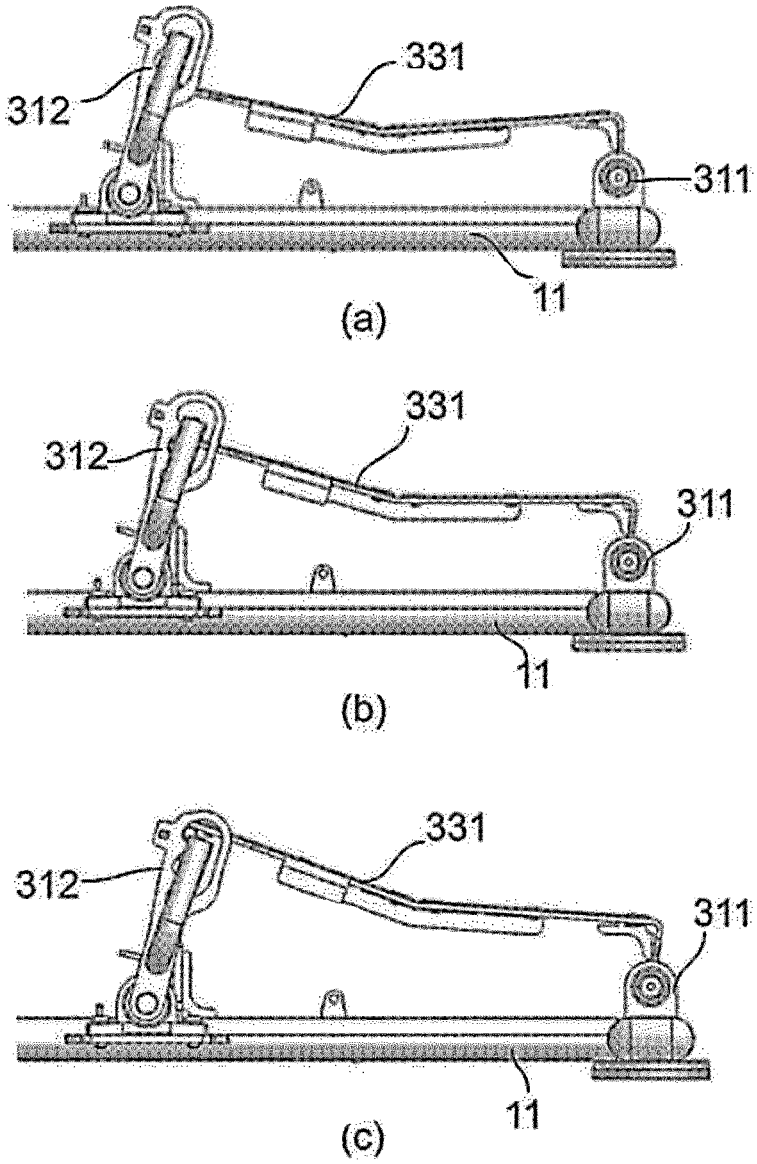
Figure 5:
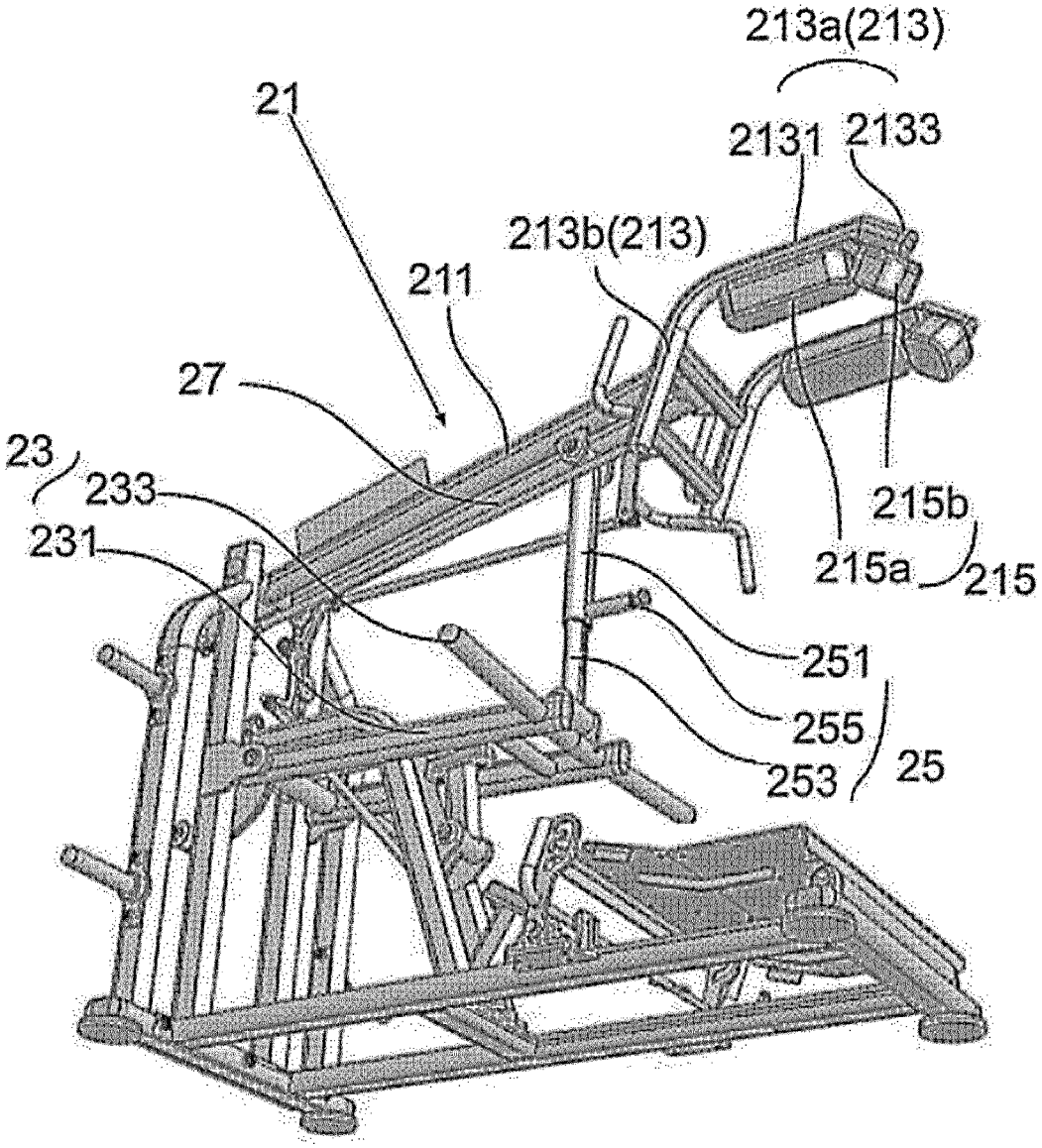
Figure 6:
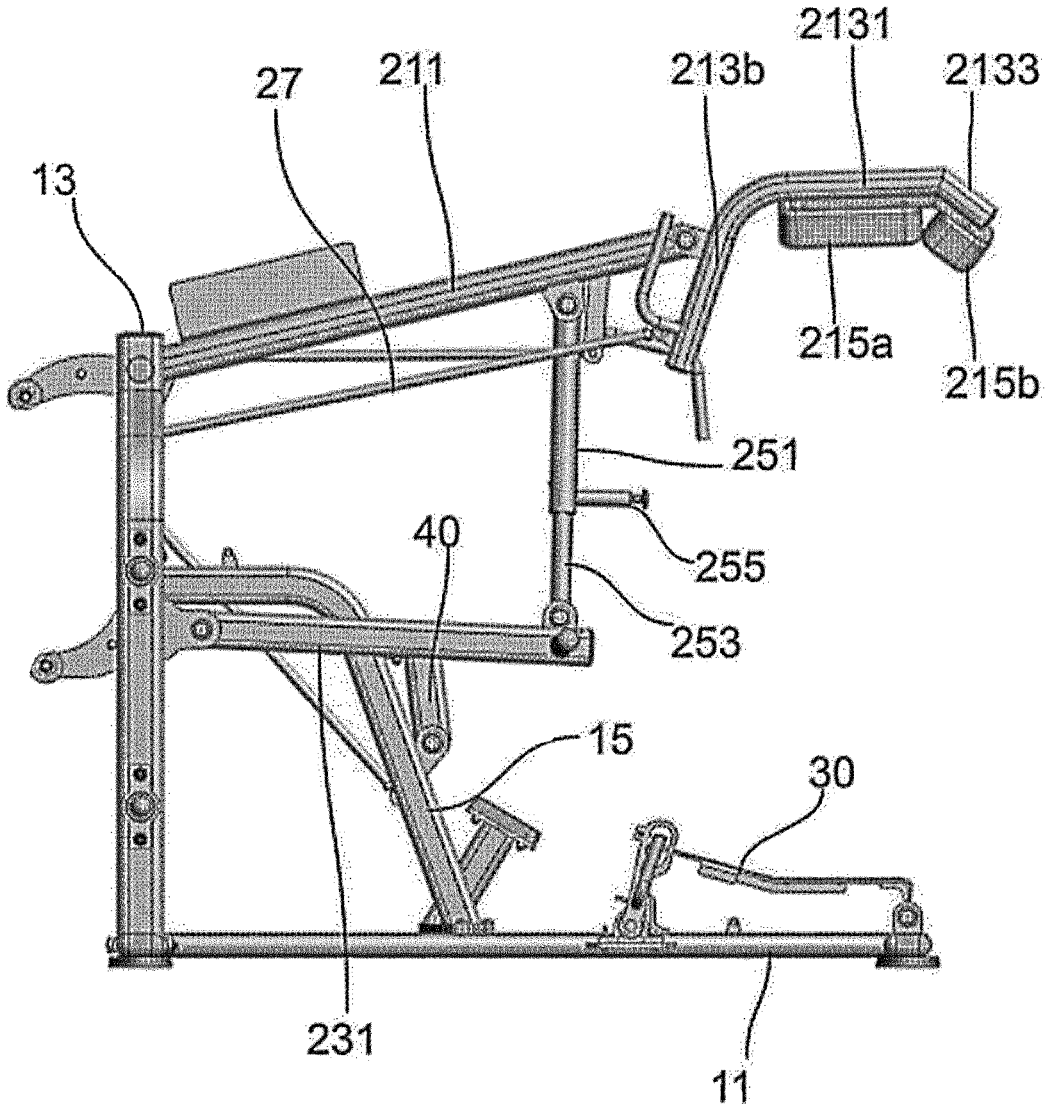
Figure 7:
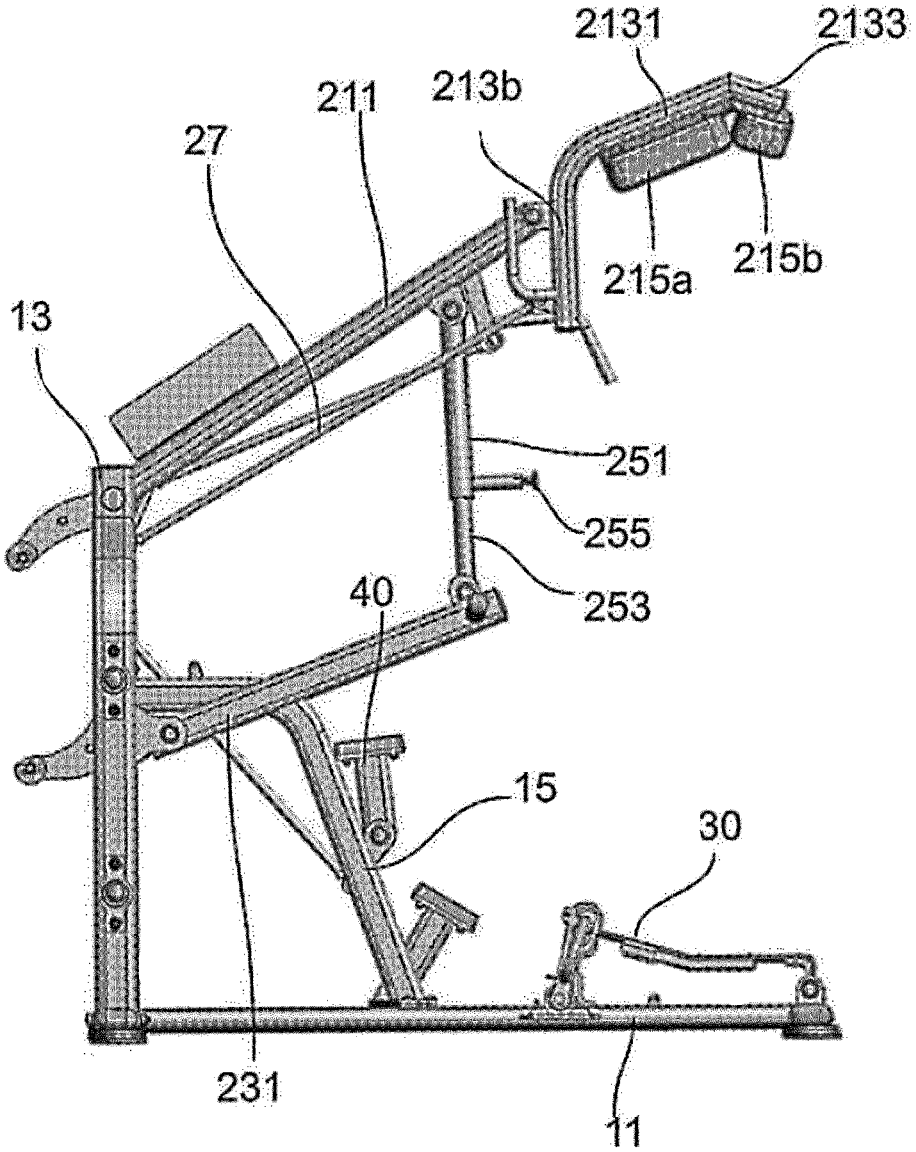
Figure 8:
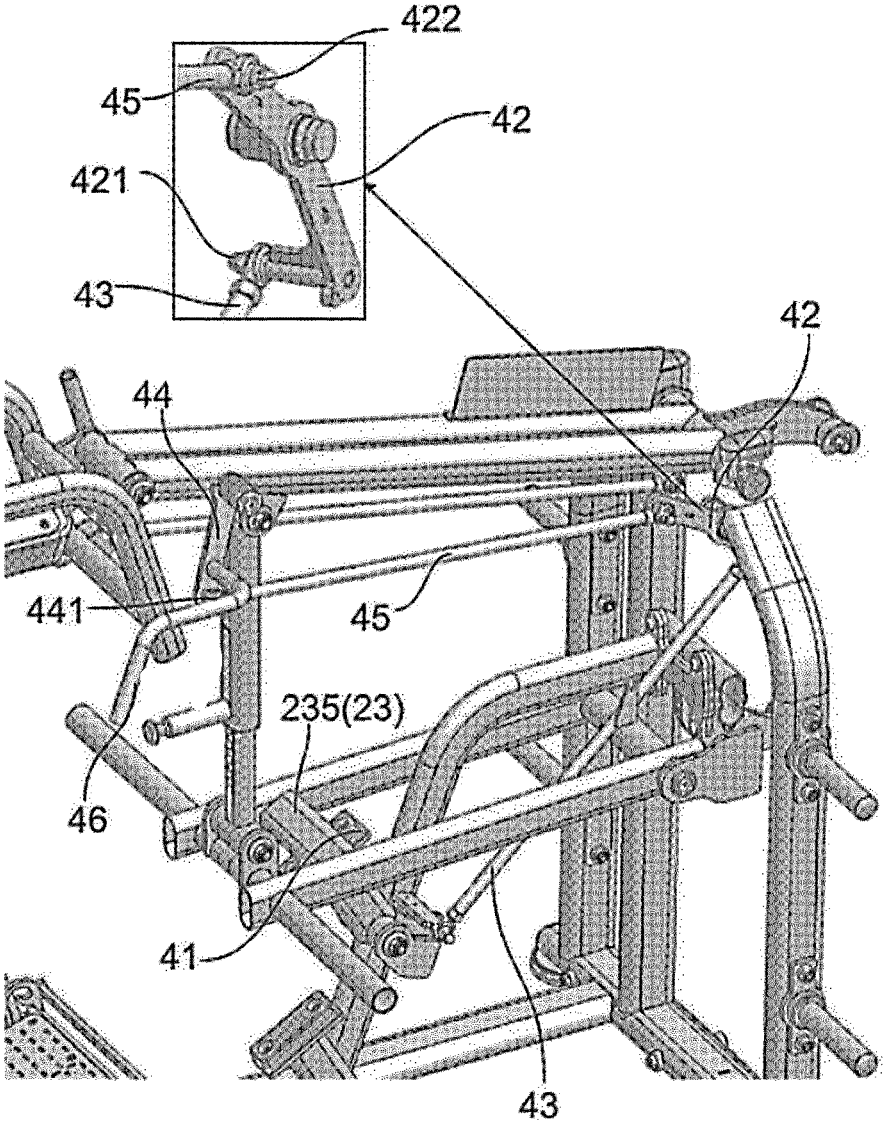
Figure 9:
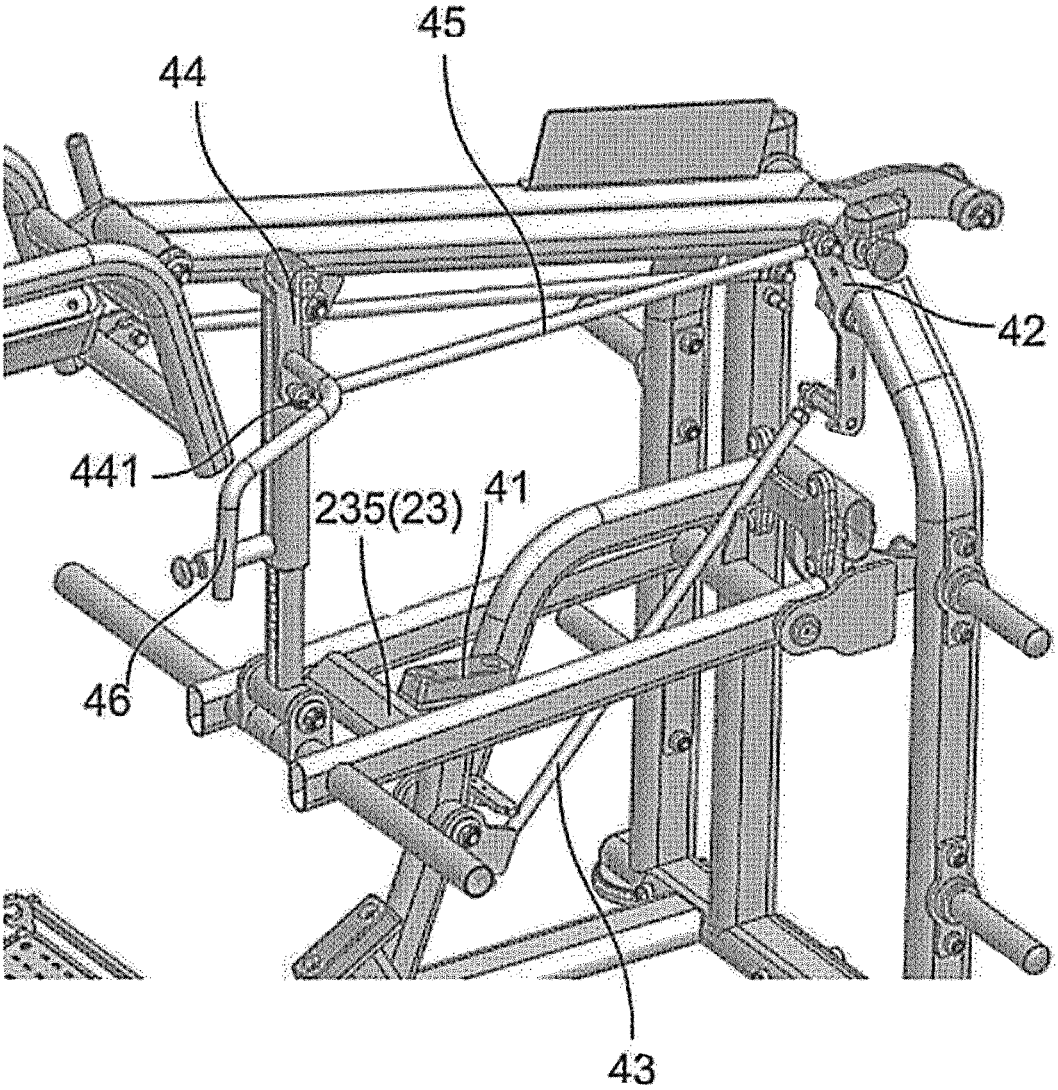

Drawings 3 and 4 are a schematic view that describes the stool unit of the standing squat calf raise according to an embodiment of this invention.

Drawings 5 to 7 is a schematic view that describes the load application unit of a standing squat calf raise according to an embodiment of this invention.

Drawings 8 and 9 are a schematic view that describes the operational mounting unit of the standing squat calf raise according to an embodiment of this invention.

DETAILED DESCRIPTION

Specific embodiments of this invention will be described in detail with reference to the drawings below. However, ideas concerning this invention shall not be limited to the presented examples, and the person skilled in the relevant field of technology will be able to easily suggest other regressive inventions or other embodiments that are included within the scope of the relevant idea by adding, changing, or deleting other elements within the scope of the same relevant ideas. However, it would also be included within the scope of the ideas relevant to this invention.

In addition, elements that hold the same function within the scope of the identical idea exhibited in the drawings of each embodiment are described using the same reference symbols.

Drawing 1 shows a schematic view of a standing squat calf raise according to an embodiment of this invention, and Drawing 2 shows a schematic view of a frame unit of the standing squat calf raise according to an embodiment of this invention.

In reference to Drawings 1 and 2, the embodied standing squat calf raise invention (1, hereinafter referred to as calf raise) describes the exercise machine in which a user can perform an act of lifting or lowering a load toward the floor on foot.

The calf raise (1) of this invention may include a frame unit (10), a load application unit (20), a stool unit (30), and an operational mounting unit (40).

The frame unit (10) may form a mounting space using multiple frames while being placed on the floor.

The frame unit (10) may include a support frame (11), a standing frame (13), a mounting frame (15), and a reinforcing frame (17).

The support frame (11) may be formed in a square-shaped frame supported on the bottom surface, and the support frame (11) can be adjusted horizontally to be leveled with the floor based on a circular support unit in contact with the bottom surface or the load applied to the support frame (11) may be transferred to the floor.

The standing frame (13) may be connected to the rear side of the support frame (11) in an upright position, and may be formed by with two support plates in parallel to each other.

The mounting frame (15) shall be connected to the standing frame (13) while protruding toward the stool base unit (30), and may provide a space where the operational mounting unit (40) is connected/installed.

As for the reinforcing frame (17), the connection of the standing frame (13) with the support frame (11) may be reinforced via the standing frame (13) and the support frame (11).

Specifically, the reinforcing frame (17) is formed on both sides of the support frame (11) to support and reinforce the two supporting units, respectively.

In addition, the reinforcing frame (17) may hold a hanging unit (171) that protrudes from the outside to provide a space for hanging objects.

The rotatable load application unit (20) is connected to the frame unit (10) and load can be applied in the direction of the bottom surface. At this time, the load from the top to the bottom part may be provided by a hanging weight or a dynamic stability created by an elastic spring.

The stool unit (30) shall be formed on the lower part of the front side of the frame unit (10) to provide a space on which the user steps on.

The operational mounting unit (40) above shall mediate the load application unit (20) and the frame unit (10), and the load application unit (20) may be mounted at a certain height.

Specifically, the operational mounting unit (40) shall be placed on a rotation path of the load application unit (20) with respect to the frame unit (10) or can deviate from the given path, and such actions can be operated by an external force applied by the user.

Description of an operational mounting unit (40) will be provided in detail with reference to Drawings 8 and 9 below.

As for the stool unit (30), the height of one rear end shall be adjusted to change the inclination of the surface on which the user steps on.

Specifically, the stool unit (30) is formed to be inclined upward from the front of the frame unit (10) toward the rear end, but its upward angle can be changed by the user.

Depending on the change in the angle of the stool unit (30), the user must change the distribution and strength of the force to keep the center of the body in its place, and this will allow the user to train the muscles in the regions where he or she wants strengthened.

Drawings 3 and 4 are a schematic view that describes the stool unit of the standing squat calf raise according to an embodiment of this invention.

In reference to Drawings 3 and 4, the stool unit (30) of the calf raise (1) according to an embodiment of this invention shall include a stool frame (31) and a stool support unit (33).

As for the stool frame (31), a primary stool landing unit (311) settled on the frame unit (31) above and the frame unit (10) while placed apart from the stool landing unit, a stool base frame having a secondary stool landing unit (312) forming multiple hanging units formed along the height direction.

As for the stool support unit (33), one side shall be connected to the primary stool landing unit (311). The other side shall provide a space for the user to step on while being connected to the secondary stool landing unit (312).

As for multiple hanging units, it shall be arranged in the order of a primary hanging (312*a*), secondary hanging (312*b*), and tertiary hanging (312*c*) parts placed facing the upper side from the lower side.

The stool support unit (33) above shall be connected to the support unit (331) consisting of a primary support plate (331*a*) and a secondary support plate (331*b*) connected to each other and to one end of the secondary support plate (331*b*) facing the secondary stool landing unit (312) at a certain angle to be equipped with an adjustment bar (333) hanging on the holding unit.

The primary support plate (331*a*) is rotatable at a certain angle while it is inserted into the primary stool landing unit (311).

By placing the primary support plate (331*a*) and the secondary support plate (331*b*) to form a specific angle, the user can maintain a more stable body balance when taking a step.

In addition, the support plate unit (331) forms fine upward protrusions to prevent slipping, and multiple through-holes formed through penetration can allow for moisture or foreign substances to deviate rather than stay on the upper side of it.

As for the adjustment bar (333), it may be hanging from any one of the hanging units above to allow for the relevant inclination to be changed with respect to the bottom surface of the support plate unit (331).

The user can adjust the upward inclination where the foot steps on by determining the height of the adjustment bar (333) in accordance with one's needs.

Drawing 4(*a*) shows a state in which the adjusting bar (333) is caught in the primary hanging unit (312*a*), Drawing 4(*b*) shows a state in which the adjusting bar (333) is caught in the secondary hanging unit (312*b*), and Drawing 4(*c*) shows a state in which the adjustment bar (333) is caught in the tertiary hanging unit (312*c*).

Drawings 5 or 7 is a schematic view that describes the load application unit of a standing squat calf raise according to an embodiment of this invention.

In reference to Drawings 5 or 7, the load application unit (20) of the calf raise (1) according to an embodiment of this invention shall include a main rotating unit (21), a sub-rotating unit (23) and a connection linkage unit (25).

As for the main rotating unit (21), it may be extended to the upper side of the stool unit (30) while being connected to the standing frame (13) to be rotatable.

Specifically, the main rotating unit (21) may include a main rotation bar (211), a load support unit (213), and a buffer unit (215).

The main rotation bar (211) may be connected to the standing frame (13) to be rotatable.

The load support unit (213) is connected to one end of the main rotation bar (211), and it may consist of a curved bar (213*b*) composed of a parallel bar (213*a*) and a curved bar (213*b*) that is curved from the parallel bar (213*a*) to provide a space for gripping.

As for the parallel bar (213*a*), it shall consist of a parallel body unit (2131) formed in a shape of a straight line and a bent unit (2133) bent from the end of the parallel body (2131).

The buffer unit (215) shall be connected to the lower side of the parallel bar (213*a*) and include a buffer unit formed of a buffer material.

Specifically, the buffer unit (215) includes a main cushion unit (215*a*) formed in the parallel body (2131) to provide a cushion-like effect and an auxiliary cushion unit (215*b*) formed in the curved part (2133) to provide a cushion-like effect.

The main cushion unit (215*a*) is supported on the user's shoulder while performing squat exercises, and the auxiliary cushion unit (215*b*) can be supported on the user's shoulder and back during the workout.

As for the sub-rotation unit (23), it is connected to the standing frame (13) while being rotatable, and it shall be placed lower than the main rotation unit (21) while it extends to the upper side of the stool unit (30).

Specifically, the sub-rotation bar (23) shall include a sub-rotation bar (231) connected to the standing frame (13) to be rotatable and a sub-mounting unit (233) connected to both ends of the sub-rotation bar (233).

The sub-mounting unit (233) can provide a space gripping while performing squatting exercises, and the user can perform lifting and lowering actions of the sub-rotation unit (23) through the sub-mounting unit (233) while the performing the lifting and lowering actions of the main rotating unit (21) supported on the shoulder and back at the same time. The connection linkage unit (25) connects the main rotation unit (21) to the sub-rotation unit (23), and changes can be made for the distance between the main rotation unit (21) and the sub-rotation unit (23).

Specifically, the connection linkage unit (25) shall be connected to the primary rotation bar (251) linked to the main rotation bar (211) to be rotatable and to the sub-rotation bar (231) to be rotatable, and it shall be equipped with a secondary rotation bar (253) connected to the primary rotation bar (251) in multiple steps concentrically and a height adjusting unit (255) that determines the sliding status of the secondary rotation bar (253) with respect to the primary rotation bar (251).

The secondary rotation bar (253) can slide along the inner circumferential surface of the hollow primary rotation bar (251), and mutual movement of the positions may be limited by the height adjustment unit (255) when it is inserted into the primary rotation bar (251) and the secondary rotation bar (253) simultaneously, or the mutual movement of their positions may be performed without any restraints when the inserted height adjustment unit (255) is released from the primary rotation bar (251).

In addition, the load application unit (20) may further be equipped with a guide linkage unit (27).

As for the guide linkage unit (27), it shall mediate the standing frame (13) and the load support unit (213) to guide the rotation of the main rotation unit (21) with respect to the standing frame (13) and shall further provide a guide link unit to reinforce the connecting structure.

Drawings 8 and 9 are schematic views that describes the operational mounting unit of the standing squat calf raise according to an embodiment of this invention.

In reference to Drawings 8 and 9, the operational mounting unit (40) of the calf raise (1) according to an embodiment of this invention shall include a settling rotation unit (41), a mounting connection unit (42), a primary operational linkage unit (43), an application rotation unit (44), a secondary operational linkage unit (45), and an application handle unit (46).

The settling rotation unit (41) may be connected to the mounting frame (15) to be rotatable.

The mounting connection unit (42) shall be connected to the standing frame (13) to be rotatable and provide a primary (421) and secondary connection rotation shafts (422).

The primary operational linkage unit (43) has a single side connected to the settling rotation unit (41) and the other side may be connected to the primary connection rotation shaft (421) to allow for the rotational force of the mounting connection unit (42) to be transmitted to the settling rotation unit (41).

The application rotation unit (44) is connected to the load application unit (20) to be rotatable and may provide a tertiary connection rotation shaft (441).

The secondary operational linkage unit (45) has a single side connected to the tertiary connection rotation shaft (441), and the other side may be connected to the secondary connection rotation shaft (422) to allow for the rotational force of the mounting connection unit (42) to be transmitted to the application rotation unit (44).

The application handle (46) shall be connected to the application rotation unit (44) and may provide a space for external force application by the user.

The rotational force applied to the application handle (46) shall be transmitted to the settling rotation unit (41) through the application rotation unit (44), the secondary operational linkage unit (45), the mounting connection unit (42), and the primary operational linkage unit (43).

Depending on the direction of the rotational force to the application handle (46), the settling rotation unit (41) shall be placed on the position movement path of the sub-rotation bar (231) to provide support for the sub-rotation bar (231) or the positional movement of the sub-rotation bar (231) may not be restricted when it deviates from the positional movement path of the sub-rotation bar (231).

Drawings 8 and 9 shows a drawing in which some components are removed from it to provide an explanation on the operational mounting unit (40).

In reference to Drawing 8, the settling rotation unit (41) is settled on the sub-connection unit (235) created between the two sub-rotating plates that make up the sub-rotation bar (231), and in this case, positional movements of the load application unit (20) to the upper part may be possible, but its positional movement to the lower part may be restricted.

Drawing 8 shows a state of exercise standby through the calf raise (1), which allows the user to prepare him/herself for the workout while stepping on the stool in the lower space of the main rotation bar (211) at a specific height.

In reference to Drawing 9, the application rotation unit (44), the secondary operational linkage unit (45), the mounting connection unit (42), the primary operational linkage unit (43), and the settling rotation unit (41) are in a rotated state due to the external force applied to the application handle, which can be considered as a state of performing the calf raise (1) exercise.

Since the settling rotation unit (41) here is placed apart from the sub-connection unit (235), it is not placed on the top-and-bottom movement path of the sub-connection unit (235), which means that the positional movement of the load application unit (20) is rather free, allowing the user to perform squat exercises.

The configuration and characteristics of this invention have been described above based on embodiments of this invention, however, the ideas concerning this invention shall not be limited to the presented examples, and it evidently states that the person skilled in the relevant field of technology is capable of making changes and modifications within the scope of the relevant idea. Therefore, it is clear that such changes or modifications shall belong to the appended scope of a request for a patent.

| [Description of Signs] | |
|---|---|
| 1: Standing squat calf raise | 10: Frame unit |
| 11: Support frame | 13: Standing frame |
| 15: Mounting frame | 17: Reinforce frame |
| 20: Load application unit | 21: Main rotation unit |
| 23: Sub-rotation unit | 25: Connection linkage unit |
| 27: Guide linkage unit | 30: Stool unit |
| 31: Stool frame | 33: Stool support unit |
| 40: Operational rotation unit | 41: Settling rotation unit |
| 42: Mounting connection unit | 43: Primary operational linkage unit |
| 44: Application rotation unit | 45: Secondary operational linkage unit |
| 46: Application handle unit | |

The invention claimed is:

1. A standing squat calf raise machine in which a user can perform an act of lifting or lowering a load toward a floor on foot, comprising:

a frame unit that forms a mounting space using multiple frames while being placed on the floor;

a rotatable load application unit connected to the frame unit with the load applied in a direction of the bottom surface;

a stool unit formed on a lower part of a front side of the frame unit configured to provide a space on which the user steps on; and an operational mounting unit mediating the load application unit and the frame unit, and the load application unit mounted at a certain height;

wherein the stool unit includes:

a height of one rear end of the standing squat calf raise configured to be adjusted to change an inclination of a surface on which the user steps on, a primary stool landing unit settled on the frame unit above and the frame unit while placed apart from the stool landing unit, a stool base frame having a secondary stool landing unit forming multiple hanging units formed along a height direction and a single side of the stool base frame connected to the primary stool landing unit, an other side having a stool support unit that provides a space for the user to step on while being connected to the secondary stool landing unit, and the multiple hanging units arranged in an other of a primary hanging, secondary hanging, and tertiary hanging parts placed facing an upper side from a lower side of the stool base frame, wherein a stool support unit is connected to a support unit consisting of a primary support plate and a secondary support plate connected to each other and one end of the secondary support plate facing the secondary stool landing part at a certain angle is equipped with an adjustment bar hanging on a holding unit, and the adjustment bar is hanging from one of the primary, secondary, and tertiary hanging parts to allow for a relevant inclination to be changed with respect to a bottom surface of a support plate unit.

2. The standing squat calf raise machine according to claim 1, the frame unit includes a rectangular frame-shaped support frame supported on the floor, a standing frame standing upright and connected to a rear side of the support frame connected to the standing frame while mediating the mounting frame that protrudes toward the stool and connected to the operational mounting unit, and the support frame is equipped with a reinforcing frame to reinforce the connection of the standing frame to the support frame, and the reinforcing frame includes one of the primary, secondary, and tertiary hanging parts protruding from an outside and formed to provide a space for hanging objects.

* * * * *